US006738490B2

(12) United States Patent
Brandt

(10) Patent No.: US 6,738,490 B2
(45) Date of Patent: May 18, 2004

(54) LOUDSPEAKER WITH INDEPENDENT MAGNETIC DAMPENING AND EXCURSION CONTROL

(76) Inventor: Eugene P. Brandt, 10825 Blandville Rd., West Paducah, KY (US) 42086

( * ) Notice: Subject to any disclaimer, the term of this patent is extended or adjusted under 35 U.S.C. 154(b) by 0 days.

(21) Appl. No.: 09/481,309

(22) Filed: Jan. 11, 2000

(65) Prior Publication Data

US 2003/0123695 A1 Jul. 3, 2003

(51) Int. Cl.[7] ..... H04R 25/00
(52) U.S. Cl. ..... 381/421; 381/412; 381/413
(58) Field of Search ..... 381/396, 407, 381/412, 413, 414, 415, 416, 417, 419, 420, 421, FOR 159, FOR 161

(56) References Cited

U.S. PATENT DOCUMENTS

| | | | | |
|---|---|---|---|---|
| 2,951,190 A | * | 8/1960 | Baermann | 381/420 |
| 3,055,991 A | * | 9/1962 | Guss | 381/421 |
| 3,917,914 A | | 11/1975 | Parker | |
| 4,465,906 A | | 8/1984 | Adolph et al. | |
| 4,609,784 A | * | 9/1986 | Miller | 381/401 |
| 4,783,824 A | * | 11/1988 | Kobayashi | 381/414 |
| 4,868,882 A | | 9/1989 | Ziegenberg et al. | |
| 5,070,530 A | * | 12/1991 | Grodinsky et al. | 381/421 |
| 5,371,806 A | | 12/1994 | Kohara et al. | |
| 5,452,366 A | * | 9/1995 | Sakamoto et al. | 381/421 |
| 5,461,677 A | | 10/1995 | Raj et al. | |
| 5,687,248 A | | 11/1997 | Yen et al. | |
| 5,715,324 A | | 2/1998 | Tanabe et al. | |
| 6,574,346 B1 | * | 6/2003 | Tanaka | 381/421 |

* cited by examiner

*Primary Examiner*—Suhan Ni
(74) *Attorney, Agent, or Firm*—King & Schickli, PLLC

(57) ABSTRACT

A loudspeaker with independent magnetic dampening and excursion control includes at least two magnets for dampening the axial movement of a voice coil. The dampening magnets substantially reduce/prevent fatigue of the component parts of the loudspeaker and detrimental contact between the voice coil and its supporting parts and the remaining component parts of the loudspeaker. A pole yoke supported by a backplate defines the inner diameter of an annular gap within which the voice coil moves and a top plate defines the outer diameter of the gap. A first dampening magnet is statically supported by the pole yoke. A second dampening magnet is supported by and moves in concert with the voice coil. As the voice coil and second magnet move within the gap, the repelling forces of the magnets provide the desired dampening effect, thus limiting or reducing the movement in one direction. Alternately, a third dampening magnet supported by an adapter is statically attached to the first dampening magnet or dynamically attached to the second dampening magnet. The third dampening magnet limits or reduces the movement of the voice coil in a second direction.

34 Claims, 3 Drawing Sheets

LOUDSPEAKER WITH INDEPENDENT MAGNETIC DAMPENING AND EXCURSION CONTROL

FIELD OF THE INVENTION

The present invention relates to the field of loudspeakers, and more particularly to loudspeakers with independent magnetic dampening and excursion control.

BACKGROUND OF THE INVENTION

Conventional loudspeakers produce audible sounds by displacing air via the movement of a diaphragm. Specifically, the diaphragm is attached to and moves under the control of a voice coil, through which electric currents associated with the sounds to be reproduced are driven. The voice coil is disposed in an annular air gap defined by a pole assembly. The pole assembly includes a permanent magnet that provides radial flux in the air gap. Current through the voice coil interacts with this flux to provide axial forces on the coil and thereby displace the coil and attached diaphragm.

The displacement or movement of the voice coil is controlled by the magnitude and direction of current in the coil and the resulting axial forces. If sufficiently high current is provided to the coil, the movement of the voice coil is limited only by the construction of the loudspeaker. Specifically, the outward movement is limited by the diaphragm or spider reaching their respective full extension. The inward movement is similarly limited by the diaphragm or spider reaching full excursion and additionally through direct contact with the pole assembly by the dust cap or the spider, or by the voice coil contacting the backplate. Over a period of time, the repeated use of these components of the loudspeaker to limit the movement of the voice coil can have significant and detrimental effects on the component parts, as well as the overall performance of the loudspeaker.

Thus, an important aspect of the present invention is, to substantially reduce, if not eliminate, the use of the component parts of the loudspeaker as movement limiters. Of course, the present invention achieves the stated goals without negatively affecting the overall performance of the loudspeaker.

SUMMARY OF THE INVENTION

Accordingly, it is a primary object of the present invention to provide an apparatus and related method for overcoming the limitations of the prior art, and to substantially reduce, if not eliminate, detrimental contact between or over extension of component parts of a loudspeaker.

Another object of the present invention is to provide an apparatus and related method for utilizing magnetic flux to provide independent dampening and excursion control.

Yet another object of the present invention is to utilize magnetic flux to limit the movement of a loudspeaker voice coil to prevent detrimental contact between or over extension of the component parts of the loudspeaker.

Still another object of the present invention is to utilize magnetic flux to maintain the component parts of the loudspeaker such as a diaphragm and/or a spider in proper position thus reducing deformation, fatigue or mechanical failure over an extended period of time.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a loudspeaker with independent magnetic dampening and excursion control for generating sound from an electrical current. The loudspeaker includes a basket, a voice coil through which the current flows, a diaphragm and a spider attached to the voice coil and basket, a pole assembly for locating the voice coil, a permanent magnet for producing a magnetic field interacting with the current to produce a movement of the voice coil, and first and second magnets that produce magnetic flux forces that provide independent dampening and excursion control. The effect of the dampening and limiting magnets is to substantially reduce, if not eliminate, detrimental contact between or over extension of the component parts of the loudspeaker.

More specifically, the pole assembly includes a pole yoke supported by a backplate, and a top plate. The pole yoke extends from the backplate through the permanent magnet and the top plate thereby defining the inner diameter of an annular gap within which the voice coil moves. The top plate and permanent magnet define the outer diameter of the gap.

Preferably, the first dampening magnet is supported by the pole yoke and the second dampening magnet is supported by and moves in concert with the voice coil. As the voice coil moves within the annular gap, the interaction of the magnetic flux forces between the dampening magnets provides a repelling or dampening force that increases as the distance between the magnets decreases. Of course, the overall make up and strength of the dampening magnets and necessarily the resulting forces are selectively controlled dependent upon the desired result.

Depending upon the placement of the second magnet relative the first magnet, the resulting dampening force may be used to prevent movement in either of two distinct directions, i.e., outward or inward. For example, an adapter mounted to an end of the voice coil may be used to support the second magnet between the first magnet and a dust cap, thus limiting the movement of the voice coil in the first, inward direction. Alternately, the adapter may be modified to support the second magnet between the first magnet and the backplate, thus limiting the movement of the voice coil in the second, outward direction.

In accordance with another important aspect of the present invention, the loudspeaker may include a third magnet to provide an additional dampening force. The forces of the first and second dampening magnets and the additional force of the third dampening magnet act to limit the movement of the voice coil independent of the direction of its movement.

It is contemplated that the third magnet may be positioned a fixed distance from the second magnet and supported by the voice coil, thus further limiting the movement of the voice coil in the outward direction. Alternatively, the third magnet may be positioned a fixed distance from the first magnet and supported by the pole assembly, thus further limiting the movement of the voice coil in the inward direction.

In addition to limiting the movement of the voice coil during use the first and second dampening magnets, and the third dampening magnet in the alternate embodiment, act to maintain the component parts of the loudspeaker such as the diaphragm and/or the spider in proper position. Advantageously, maintaining the parts in proper position helps prevent deformation from repeated over-extension and/or component-component contact thus insuring that maximum and uniform efficiencies are maintained over an extended service life interval of the loudspeaker.

In accordance with the method of the present invention, a magnetic field is generated within the loudspeaker by the permanent magnet which interacts with the current flowing through the voice coil to move the voice coil. The movement of the voice coil, however, is, limited by magnetic flux forces generated by dampening magnets. Advantageously, the dampening magnets substantially reduce/prevent fatigue of the component parts of the loudspeaker and detrimental contact between the voice coil and its supporting parts and the remaining component parts of the loudspeaker.

The method of limiting the movement of a voice coil within a loudspeaker may include the additional steps of dynamically supporting a first magnet for movement with the voice coil, and statically supporting a second magnet with the pole assembly in order to generate the desired magnetic flux forces.

Still other objects of the present invention will become apparent to those skilled in this art from the following description wherein there is shown and described the preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
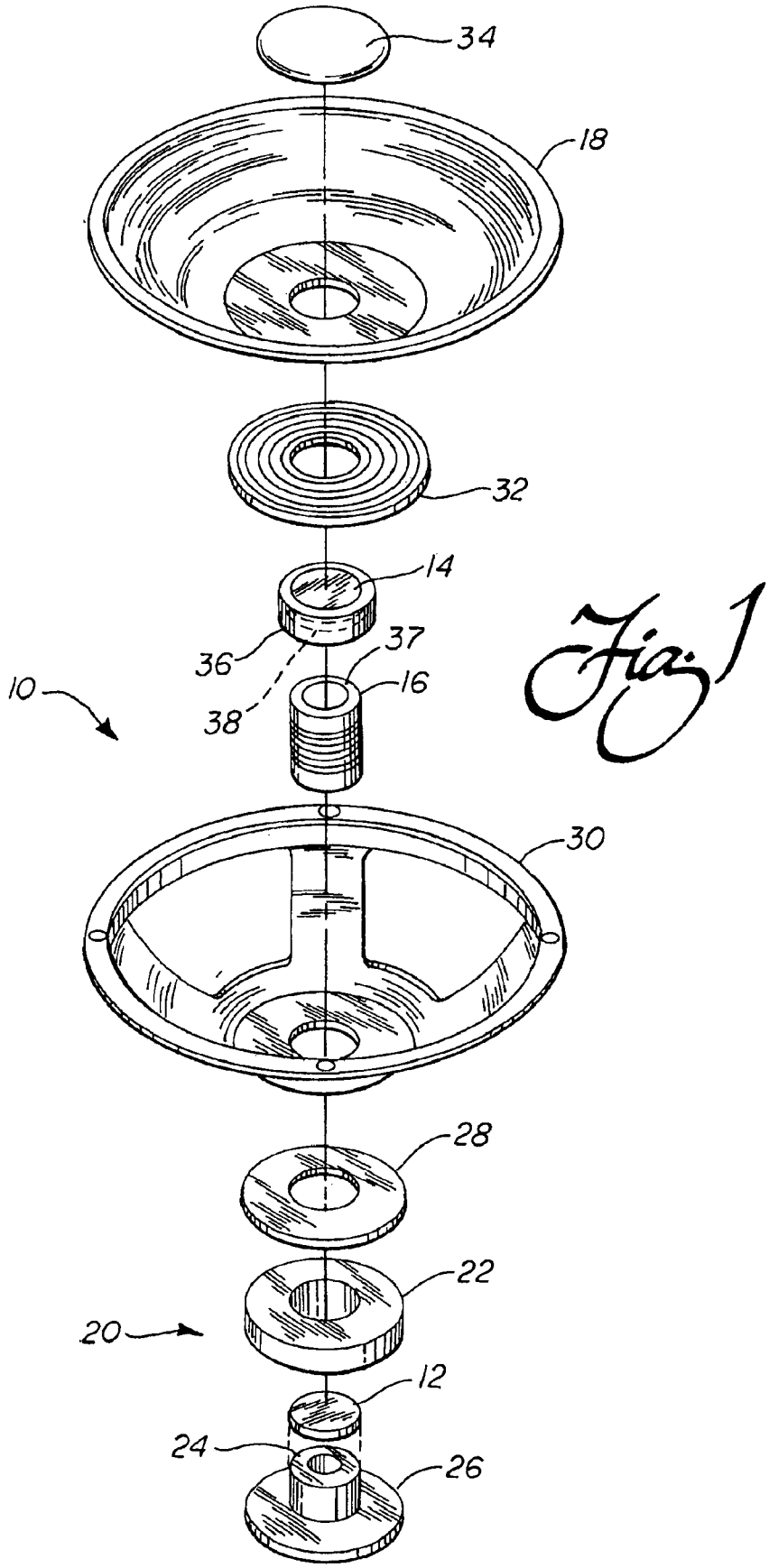
FIG. 1 is an exploded isometric view of a loudspeaker in accordance with the present preferred invention.

With reference to the exploded view of FIG. 1, there is shown a preferred embodiment of a loudspeaker 10 with independent magnetic dampening and excursion control for generating sound from an electrical current. The loudspeaker 10 is of a type generally known in the art but includes first and second magnets 12 and 14 that produce magnetic flux forces which dampen and thus limit the movement of a voice coil 16. Dampening or limiting the movement of the voice coil 16 substantially reduces, if not eliminates, fatigue of the component parts of the loudspeaker 10 and detrimental contact between the voice coil 16 and its supporting parts and the remaining component parts of the loudspeaker.

Figure 2:
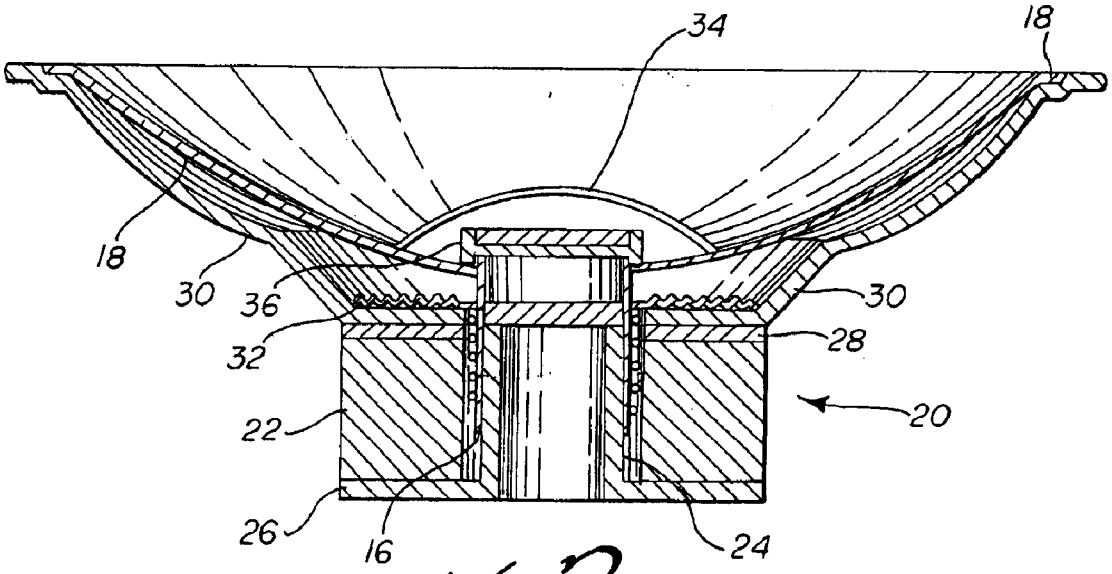
FIG. 2 is a cross-sectional view of the loudspeaker illustrating the present preferred placement of the dampening magnets.

The loudspeaker 10, shown in cross section in FIG. 2, includes a deflectable diaphragm 18 which is attached to and controlled by the movements of the voice coil 16. The voice coil 16 is located and moves within an annular gap defined by a pole assembly 20. Specifically, the pole assembly 20 includes a permanent magnet 22, a pole yoke 24 supported by a backplate 26, and a top plate 28. Pole yoke 24, backplate 26 and top plate 28 are each constructed from a non-magnetic material. The pole yoke 24 extends through the permanent magnet 22 and the top plate 28 and defines the inner diameter of the annular gap within which the voice coil 16 moves. The top plate 28 and permanent magnet 22 define the outer diameter of the gap.

In accordance with standard loudspeaker operation, the permanent magnet 22 produces a magnetic field within the air gap interacting with the current to produce the movement of the voice coil 16. The voice coil 16 then moves the diaphragm 18 to produce the sound. A basket 30 is attached to and supports the pole assembly 20, the diaphragm 18, and a spider 32 for maintaining the central position of the coil 16. A dust cap 34 fits over an aperture in the center of the diaphragm 18.

Figure 3:
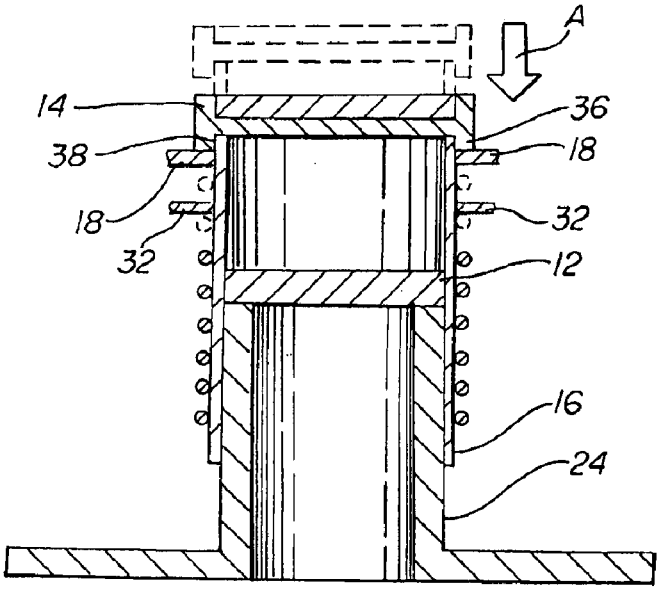
FIG. 3 is a partial cross-sectional view of the loudspeaker illustrating the dampened inward movement of the voice coil.

In the preferred embodiment of the present invention shown in FIG. 3, the first dampening magnet 12 is supported by the pole yoke 24 and the second dampening magnet 14 is supported by and moves in concert with the voice coil 16. The dampening magnets 12 and 14 each have opposite polarities, and are positioned such that their respective like polarities face one another, e.g., N-N or S-S. As the voice coil 16 moves within the annular gap, the interaction of the magnetic flux forces associated with the dampening magnets 12 and 14 provides a repelling or dampening force against the movement of the coil 16 that increases as the distance between the magnets decreases. Of course, the strength of the dampening magnets 12 and 14 is preselected so as to provide the desired dampening effect without degrading sound reproduction performance.

In the present preferred embodiment, the dampening magnets 12 and 14 are a rare-earth magnetic material, Neodymium (NdFeEB). The Maximum Energy Product of this material, BH Max (or Flux Intensity Maximum), is typically 30 or more and up to 50 MGOe, (mega gauss oersted) a measure of magnetic field strength. For the present preferred embodiment, the magnetic material used for the dampening magnets 12 and 14 is in the 30 MGOe range and achieved resistive forces when like poles of the magnets were brought together of approximately 21 pounds for each ounce of magnetic material used per repelling magnet. The size and shape of the magnets 12 and 14 affect the repelling forces which in general are very small at a separation distance of three-quarters of an inch or more but become exponentially stronger as the like poles of the magnets 12 and 14 are brought closer. Maximum forces are achieved just before contact between the dampening magnets.

Figure 4:
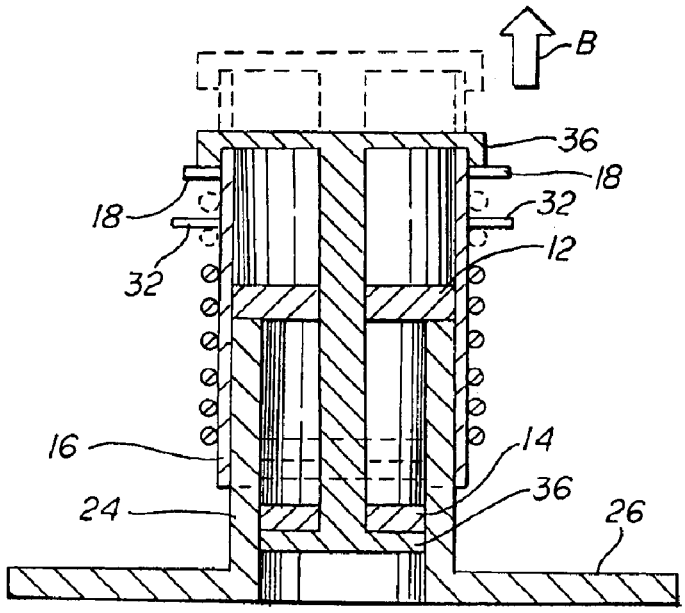
FIG. 4 is a partial cross-sectional view of an alternate embodiment of the loudspeaker illustrating the dampened outward movement of the voice coil.

Depending upon the placement of the second magnet 14 relative the first magnet 12, the resulting dampening force may be used to prevent movement in either of two distinct directions, i.e., either outward or inward. For example, an adapter 36 mounted on an end 37 of the voice coil 16 may be used to support the second magnet 14 between the first magnet 12 and the dust cap 34 (not shown). In this manner, the movement of the coil 16 in the first or inward direction (shown by action arrow A) is limited. The preferred adapter 36 defines an annular aperture 38 for receiving the voice coil 16, and supports the second magnet 14. Alternately, as shown in FIG. 4, the adapter 36 may be modified in any manner to support the second magnet 14 for movement between the first magnet 12 and the backplate 26. This alternate arrangement of the dampening magnets 12 and 14 limits the movement of the voice coil 16 in the second or outward direction (shown by action arrow B). It should be appreciated that while a substantially T-shaped adapter 36 is shown in FIG. 4, any type and shape of adapter may be utilized to support the second dampening magnet 14 in accordance with the broad teachings of the present invention.

Figure 5:
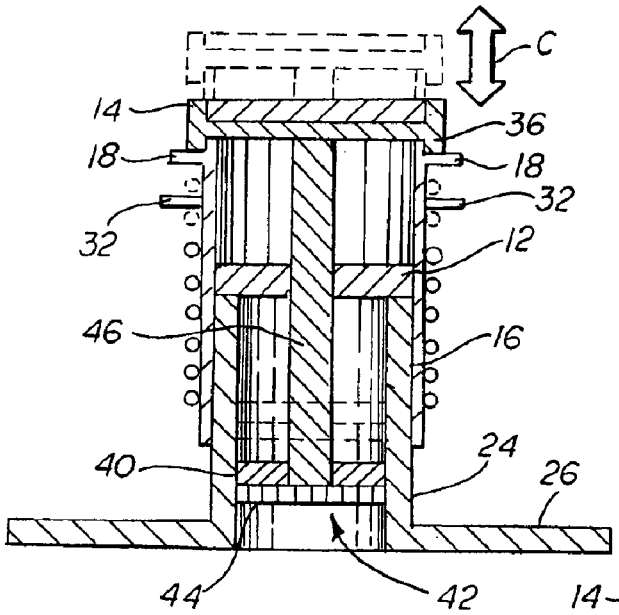
FIG. 5 is a partial cross-sectional view of an alternate embodiment of the loudspeaker illustrating the dampened inward and outward movement of the voice coil and the placement of the dampening magnets.
Figure 6:
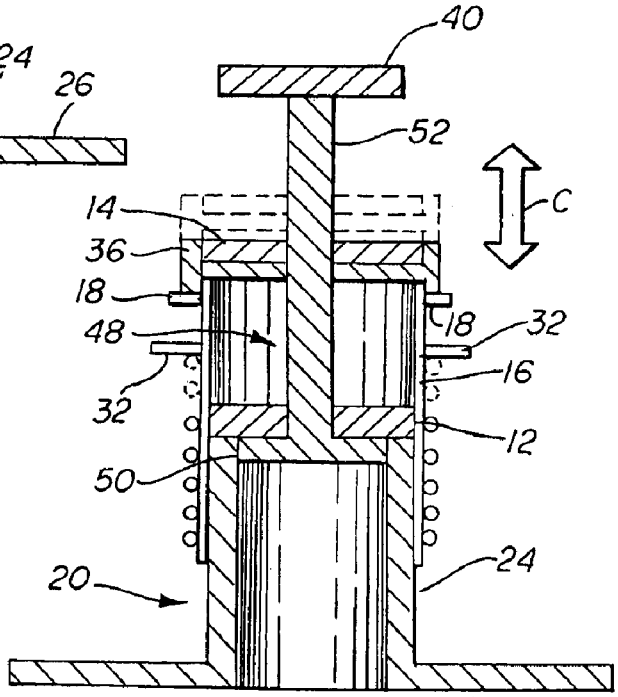
FIG. 6 is a partial cross-sectional view of yet another alternate embodiment of the loudspeaker illustrating the dampened movement of the voice coil and the alternate placement of the dampening magnets.

FIGS. 5 and 6 illustrate alternate embodiments of the present invention which include a third dampening magnet 40. In accordance with an important aspect of the invention, the third magnet 40 acts in cooperation with either the first magnet 12 or the second magnet 14 to limit the movement of the voice coil 16 independent of its direction of movement (shown by action arrow C). More specifically, the third dampening magnet 40 provides an additional dampening force which interacts with the dampening forces of the first or second magnets, 12 or 14, to limit the movement of the voice coil 16 in either the inward or outward direction.

In accordance with the embodiment shown in FIG. 5, the third dampening magnet 40 is supported by and moves in concert with the voice coil 16 a distance from the first magnet 12, thus limiting the movement of the voice coil 16 in the outward direction. A substantially T-shaped adapter 42, for example, may be used to support the third magnet 40 a fixed distance from the second magnet 14 and at the desired distance from the first magnet 12. It should be clear that numerous other adapters capable of supporting the magnets in this arrangement may also be used in accordance with the broad teaching of the present invention.

The present preferred adapter 42, for this embodiment however, includes a cross member 44 and a depending leg 46 supported by the adapter 36, or directly by the second dampening magnet 14. The adapters 36 and 42 may be combined into a unitary adapter, if desired. The depending leg 46 of adapter 42 extends through the first magnet 12, and at least partially through the pole assembly 20 supporting the third dampening magnet 40 at the desired distance from the first dampening magnet 12, a fixed distance from the second dampening magnet 14.

In this manner, as the voice coil 16 moves inwardly, the repulsion forces between the first magnet 12 and second magnet 14 interact to limit or dampen the movement of the voice coil 16. As the voice coil moves outwardly, on the other hand, the repelling forces between the first magnet 12 and the third magnet 40 increase, interacting to again limit or dampen the movement of the voice coil 16.

Alternatively as shown in FIG. 6, the third dampening magnet 40 may be statically supported by the pole assembly 20 at the desired distance from the second magnet 14, thus limiting the movement of the voice coil 16 in the outward direction. The interaction of the dampening forces associated with the second magnet 14 and the first magnet 12 further limit the movement of the voice coil 16 in the inward direction. Again, a substantially T-shaped adapter 48 may be used to support the third magnet 40 at the desired distance from the second magnet 14, a fixed distance from the first magnet 12. In this alternate embodiment, the adapter 48 includes cross member 50 and depending leg 52. The depending leg 52 preferably extends at least partially through the pole assembly 20 and voice coil 16, through the first magnet 12, the adapter 36 and the second magnet 14, and supports the third dampening magnet 40 at the desired fixed distance from the first dampening magnet 12. The third magnet 40 may be supported by depending leg 52 directly, or by a suitable adapter (not shown).

In addition to limiting the movement of the voice coil 16 during use, the first and second dampening magnets 12, 14, and the third dampening magnet 40 in the alternate embodiments, help maintain the component parts of the loudspeaker 10 such as the diaphragm 18 and/or the spider 38 in proper position. Advantageously, maintaining the parts in proper position helps prevent deformation or the like from repeated over-extension and/or component contact thus insuring that maximum and uniform efficiencies are maintained over an extended service life of the loudspeaker.

In accordance with the method of the present invention, a magnetic field is generated within the loudspeaker 10 by the permanent magnet 22 which interacts with the current flowing through the voice coil 16 to move the voice coil 16 within the defined air gap. In accordance with an important aspect of the present invention, the movement of the voice coil 16 is limited by the magnetic flux forces generated by first and second magnets 12 and 14. Advantageously, the first and second magnets 12 and 14 substantially reduce/prevent fatigue of the component parts of the loudspeaker and detrimental contact between the voice coil 16 and its supporting parts and the remaining component parts of the loudspeaker 10.

The method of limiting the movement of a voice coil within a loudspeaker may include the additional steps of dynamically supporting a first magnet for movement with the voice coil, and statically supporting a second magnet with the pole assembly in order to generate the desired magnetic flux forces.

The foregoing description of a preferred embodiment of the invention has been presented for purposes of illustration and description. It is not intended to be exhaustive or to limit the invention to the precise form disclosed. Obvious modifications for variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A magnetically dampened loudspeaker for generating sound from an electrical current, the loudspeaker comprising:

a voice coil through which the current flows;

a diaphragm attached to said voice coil;

a pole assembly defining an annular gap in which the voice coil is located, the annular gap having an inner and outer diameter;

a permanent magnet for producing a magnetic field in the annular gap, the magnetic field interacting with the current to produce an axial movement of said voice coil;

at least two magnets for dampening and thus limiting the movement of said voice coil;

wherein said pole assembly includes a backplate for supporting a pole yoke, said pole yoke defining the inner diameter of the annular gap and extending through said permanent magnet, and a top plate, said top plate defining the outer diameter of the annular gap; and wherein said at least two magnets include a first dampening magnet supported by said pole yolk and a second dampening magnet supported by said voice coil.

2. The magnetically dampened loudspeaker of claim 1, wherein said second dampening magnet is supported by said voice coil between said first dampening magnet and a dust cap to dampen and thus limit/reduce the movement of said voice coil in a first direction.

3. The magnetically dampened loudspeaker of claim 2, further comprising an adapter having an annular aperture for receiving an end of said voice coil, said adapter supporting said second dampening magnet.

4. The magnetically dampened loudspeaker of claim 1, wherein said second dampening magnet is supported by said voice coil between said first dampening magnet and said backplate to dampen and thus limit/reduce the movement of said voice coil in a second direction.

5. The magnetically dampened loudspeaker of claim 1, further including a third dampening magnet supported by said voice coil, said first and second magnets positioned to repel one another in a first direction, and said first and third magnets positioned to repel one another in a second direction for dampening and thus limiting/reducing the movement of said voice coil in both directions.

6. The magnetically dampened loudspeaker of claim 5, further comprising an adapter supported by said voice coil for supporting said second dampening magnet.

7. The magnetically dampened loudspeaker of claim 6, wherein said adapter is substantially T-shaped including a cross member and a depending leg, said cross member supporting said second dampening magnet and having an annular aperture for receiving said voice coil, and said depending leg extending through apertures in said top plate, said pole yoke, and said permanent magnet and supporting said third dampening magnet.

8. The magnetically dampened loudspeaker of claim 1, further including a third dampening magnet supported by said pole yoke, said first and second magnets positioned to repel one another in a first direction and said second and third magnets positioned to repel one another in a second direction for dampening and thus limiting/reducing the axial movement of said voice coil in both directions.

9. The magnetically dampened loudspeaker of claim 8, further comprising an adapter supported by said pole yoke for supporting said third dampening magnet.

10. The magnetically dampened loudspeaker of claim 9, wherein said adapter is substantially T-shaped including a cross member and a depending leg, said cross member supporting said first dampening magnet, and said depending leg extending through an aperture in said pole yoke and supporting said third dampening magnet.

11. A magnetically dampened loudspeaker for generating sound from an electrical current, the loudspeaker comprising:

a voice coil through which the current flows;

a diaphragm attached to said voice coil;

a pole assembly defining an annular gap in which said voice coil is located, the annular gap having an inner and outer diameter;

a permanent magnet for producing a magnetic field in the annular gap, the magnetic field interacting with the current to produce an axial movement of said voice coil; and at least two magnets acting to repel one another for dampening and thus limiting the movement of said voice coil without modifying the current flowing through said voice coil.

12. The magnetically dampened loudspeaker of claim 11, wherein said pole assembly includes a backplate for supporting a pole yoke, said pole yoke defining the inner diameter of the annular gap and extending through said permanent magnet, and a top plate, said top plate defining the outer diameter of the annular gap.

13. The magnetically dampened loudspeaker of claim 12, wherein at least one of said dampening magnets is supported by said voice coil.

14. The magnetically dampened loudspeaker of claim 13, further comprising an adapter supported by said voice coil, said adapter supporting said second dampening magnet and a third dampening magnet.

15. The magnetically dampened loudspeaker of claim 14 wherein said adapter is substantially T-shaped including a cross member and a depending leg, said cross member supporting said second dampening magnet, and said depending leg extending through apertures in said top plate, said pole yoke, and said permanent magnet, and supporting said third dampening magnet such that said first and second magnets are positioned to repel one another when said voice coil moves in a first axial direction, and said first and third magnets are positioned to repel one another when said voice coil moves in a second axial direction.

16. The magnetically dampened loudspeaker of claim 11, wherein at least one of said dampening magnets is supported by said voice coil.

17. The magnetically dampened loudspeaker of claim 16, further comprising an adapter supported by said voice coil, said adapter supporting said second dampening magnet and a third dampening magnet such that said first and second magnets are positioned to repel one another when said voice coil moves in a first axial direction, and said first and third magnets are positioned to repel one another when said voice coil moves in a second axial direction.

18. The magnetically dampened loudspeaker of claim 17 wherein said adapter is substantially T-shaped including a cross member and a depending leg, said cross member supporting said second dampening magnet, and said depending leg supporting said third dampening magnet.

19. The magnetically dampened loudspeaker of claim 11 further comprising a basket;

a spider attached to said basket, said spider for maintaining the position of said voice coil; and wherein said diaphragm is attached to said voice coil and said basket and said pole assembly is attached to said basket.

20. The magnetically dampened loudspeaker of claim 19, wherein at least one of said dampening magnets is supported by said voice coil.

21. The magnetically dampened loudspeaker of claim 20, further comprising an adapter supported by said voice coil, said adapter supporting said second dampening magnet and a third dampening magnet.

22. The magnetically dampened loudspeaker of claim 11 further comprising means for supporting at least one dampening magnet.

23. The magnetically dampened loudspeaker of claim 22, wherein said support means is supported by said voice coil.

24. The magnetically dampened loudspeaker of claim 23, wherein said support means supports said second dampening magnet and a third dampening magnet.

25. The magnetically dampened loudspeaker of claim 24 wherein said first and second magnets are positioned to repel one another when said voice coil moves in a first axial direction, and said first and third magnets are positioned to repel one another when said voice coil moves in a second axial direction.

26. The magnetically dampened loudspeaker of claim 22, wherein said support means is supported by said pole assembly.

27. The magnetically dampened loudspeaker of claim 26, wherein said support means supports a third dampening magnet.

28. The magnetically dampened loudspeaker of claim 27 wherein said first and second magnets are positioned to repel one another when said voice coil moves in a first axial direction, and said first and third magnets are positioned to repel one another when said voice coil moves in a second axial direction.

29. A method of limiting/reducing the movement of a voice coil within a loudspeaker comprising the steps of:

generating a magnetic field within the loudspeaker;

flowing a current through said voice coil sufficient to interact with said magnetic field and move said voice coil;

producing magnetic flux forces dependent upon the movement of said voice coil sufficient to limit/reduce the movement of said voice coil;

dynamically supporting a first magnet for movement with said voice coil; and statically supporting a second magnet with a pole assembly, whereby fatigue and/or detrimental contact is substantially reduced/prevented.

30. The method of limiting/reducing the movement of a voice coil within a loudspeaker of claim 29 further comprising the step of dynamically supporting a third magnet for movement with said voice coil.

31. The method of limiting/reducing the movement of a voice coil within a loudspeaker of claim 29 further comprising the step of statically supporting a third magnet an adapter supported by said pole assembly.

32. A magnetically dampened loudspeaker for generating sound from an electrical current, the loudspeaker comprising:

a voice coil through which the current flows;

a diaphragm attached to said voice coil;

a pole assembly defining an annular gap in which said voice coil is located, the annular gap having an inner and outer diameter;

a permanent magnet for producing a magnetic field in the annular gap, the magnetic field interacting with the current to produce an axial movement of said voice coil; and at least two magnets, at least one of said magnets supported by said voice coil, acting to repel one another for dampening and thus limiting the movement of said voice coil.

33. The magnetically dampened loudspeaker of claim 32, further comprising an adapter supported by said voice coil, said adapter supporting said second dampening magnet and a third dampening magnet such that said first and second magnets are positioned to repel one another when said voice coil moves in a first axial direction, and said first and third magnets are positioned to repel one another when said voice coil moves in a second axial direction.

34. The magnetically dampened loudspeaker of claim 33 wherein said adapter is substantially T-shaped including a cross member and a depending leg, said cross member supporting said second dampening magnet, and said depending leg supporting said third dampening magnet.

* * * * *